United States Patent [19]

McGann

[11] Patent Number: 4,565,142

[45] Date of Patent: Jan. 21, 1986

[54] SEWING MACHINE BED EXTENSION

[75] Inventor: Leo E. McGann, Cranford, N.J.

[73] Assignee: The Singer Company, Stamford, Conn.

[21] Appl. No.: 743,124

[22] Filed: Jun. 10, 1985

[51] Int. Cl.[4] ..... D05B 73/10

[52] U.S. Cl. ..... 112/260; 108/1; 312/313; D15/69

[58] Field of Search ..... 112/260, 258, 13; 108/1; 312/313, 314, 315, 316; D15/69, 76

[56] References Cited

U.S. PATENT DOCUMENTS

| | | | |
|---|---|---|---|
| D. 276,614 | 12/1984 | La Police et al. | D15/69 |
| 1,360,357 | 11/1920 | Bauer | 112/260 |
| 2,341,975 | 2/1944 | Chason | 112/260 |
| 2,424,025 | 7/1947 | Gegauf | 112/260 |
| 4,204,493 | 5/1980 | Blackwood et al. | 112/260 |
| 4,314,517 | 2/1982 | Kasahara et al. | 112/260 |

FOREIGN PATENT DOCUMENTS

| | | | |
|---|---|---|---|
| 787234 | 12/1957 | United Kingdom | 112/260 |

*Primary Examiner*—Werner H. Schroeder
*Assistant Examiner*—Andrew M. Falik
*Attorney, Agent, or Firm*—Robert E. Smith; Edward L. Bell

[57] ABSTRACT

A one-piece sewing machine bed extension including portions which deform as the extension is placed on a sewing machine and generate internal stresses coacting with interlocks between the bed extension and sewing machine so arranged as to firmly secure the bed extension in place in a manner which is augmented by forces applied to the bed extension incident to normal operation and handling of the sewing machine.

5 Claims, 4 Drawing Figures

SEWING MACHINE BED EXTENSION

BACKGROUND OF THE INVENTION

This invention relates to sewing machines having an integral cantilevered work supporting bed, referred to in the art as a cylinder bed or a free arm, upon which tubular work pieces may be accommodated for sewing, and more particularly, to a bed extension and fastening arrangement for readily attaching and removing the bed extension from the sewing machine cylinder bed.

DESCRIPTION OF THE PRIOR ART

The following patents are representative of prior known fastening arrangements for retaining bed extensions to sewing machine cylinder beds:

U.S. Pat. No. D. 276,614—12/04/84—LaPolice et al;
U.S. Pat. No. 4,204,493—5/27/80—Blackwood et al;
U.S. Pat. No. 2,424,025—07/15/47—Gegauf;
Japanese No. 53-120561—09/26/78—Watanabe.

There are bed extensions in the prior art which do not lock securely to the sewing machine bed and can easily be dislodged during work manipulation on the sewing machine bed. Those that have afforded a degree of secure fastening have required complicated and costly latches, spring locks or cumbersome arrangements clamping the bed extension completely about the sewing machine cylinder bed.

SUMMARY OF THE INVENTION

It is an object of this invention to provide a sewing machine bed extension which may be formed in a single, unitary piece without involving any articulated parts requiring assembly on either of the bed extension or on the sewing machine bed yet providing a secure fastening for the bed extension on the sewing machine capable not only of resisting dislodgement during normal handling of work on the sewing machine bed but also resisting dislodgement in the event that the sewing machine is lifted by grasping the projecting free extremity of the bed extension.

This object of the invention is attained by a bed extension construction with integrally formed projections arranged in spaced relation thereon, which projections are engagable with reception sockets formed in said sewing machine only after interference between the bed extension and the sewing machine bed has been overcome by limited deformation of the bed extension. The deformation develops a locking force firmly retaining the projections seated in the reception sockets.

DESCRIPTION OF THE DRAWINGS

The above and additional objects and advantages of this invention will be apparent from the description set forth hereinbelow of a preferred embodiment illustrated in the accompanying drawings in which.

DESCRIPTION OF THE PREFERRED EMBODIMENT

Figure 1:
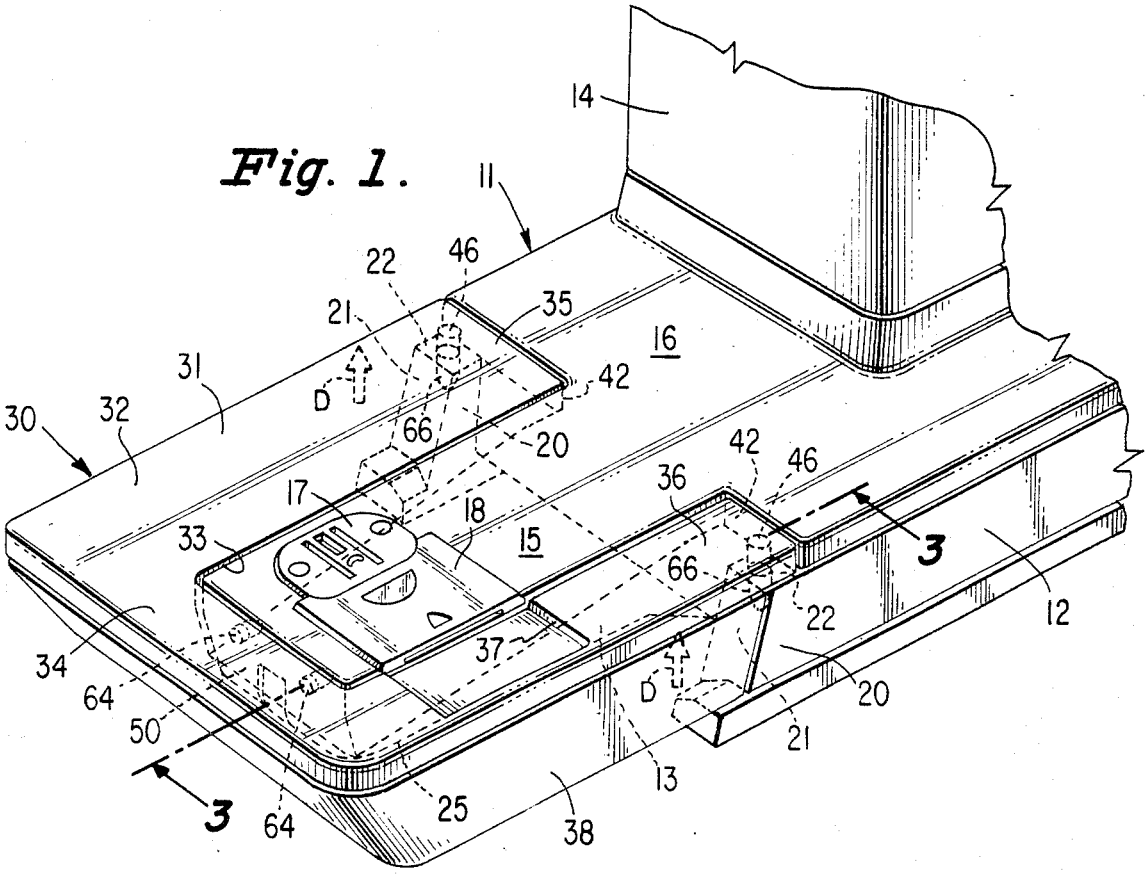
FIG. 1 is a perspective view of a portion of a sewing machine having a bed extension in accordance with this invention secured thereto.

Referring to the drawings, 11 indicates generally a sewing machine having a supporting base 12 from which projects a cantilivered cylinder bed 13. Rising from the base 12 is a standard 14 which supports additional frame structure (not shown) which may be of any conventional arrangement overhanging the bed 13 for sustaining stitch forming instrumentalities cooperating with instrumentalities in the bed in the formation of stitches.

The cylinder bed 13 of the sewing machine is formed with a flat horizontal work supporting surface 15 which is preferably narrower than and coplanar with a work supporting surface 16 which extends over portions of the base 12. Near the free extremity of the cylinder bed a throat plate 17 is fixed above stitch forming instrumentalities (not shown) within the cylinder bed and a slide cover plate 18 is retractable to the right as viewed in FIGS. 1 and 2 to provide access to the instrumentalities therebeneath; both the slide plate and throat plate being substantially flush with the work supporting surface 15 of the cylinder bed.

The base 12 on each side of the cylinder bed 13 is formed with a small projection 20, each projection preferably extending parallel to the cylinder bed and formed with an inclined free extremity 21 and an upper surface 22 parallel to and beneath the level of the work supporting surfaces 15, 16 of the cylinder bed and base.

The sewing machine thus far described provides a structure ideally suited for sewing on tubular work pieces since the undersurface 25 of cylinder bed 13 extends above the level of the base 12 so that tubular work pieces such as stockings, sleeves and the like may conveniently be accommodated on the cylinder bed.

The narrow work supporting surface 15 of the cylinder bed, however, may impose difficulties in the handling of flat work pieces, particularly flat work pieces of large size. What is required to facilitate sewing of flat work pieces, therefore, is a means for extending the work supporting bed surface 15. To be practical and acceptable, a bed extension must be cost effective; must be able to be applied and removed quickly and easily; must resist dislodgement under the influence of forces applied to it incident to work fabric manipulation during sewing; and must remain securely fastened when grasped adjacent the free extremity of the cylinder bed incident to lift and transport of the sewing machine.

The above essential attributes are provided by the bed extension of this invention which will now be described.

As illustrated in the accompanying drawings, the bed extension indicated generally at 30 comprises an integral molded one-piece unit preferably formed of synthetic plastic by an injection molding process. The bed extension 30 is formed with a U-shaped work supporting plate 31 providing a planar upper work supporting surface 32. The plate 31 is formed with a central recess 33 shaped to conform with that of the cylinder bed work supporting surface 15, thus defining the U-shape of the plate 31 including a base portion 34 and spaced arms 35–36.

A shallow depression 37 may be formed in the upper work supporting surface of one arm 36 of the bed extension work supporting plate 31 to accommodate retraction of the sewing machine slide cover plate 18 while the bed extension 30 is secured in place on the sewing machine.

Figure 2:
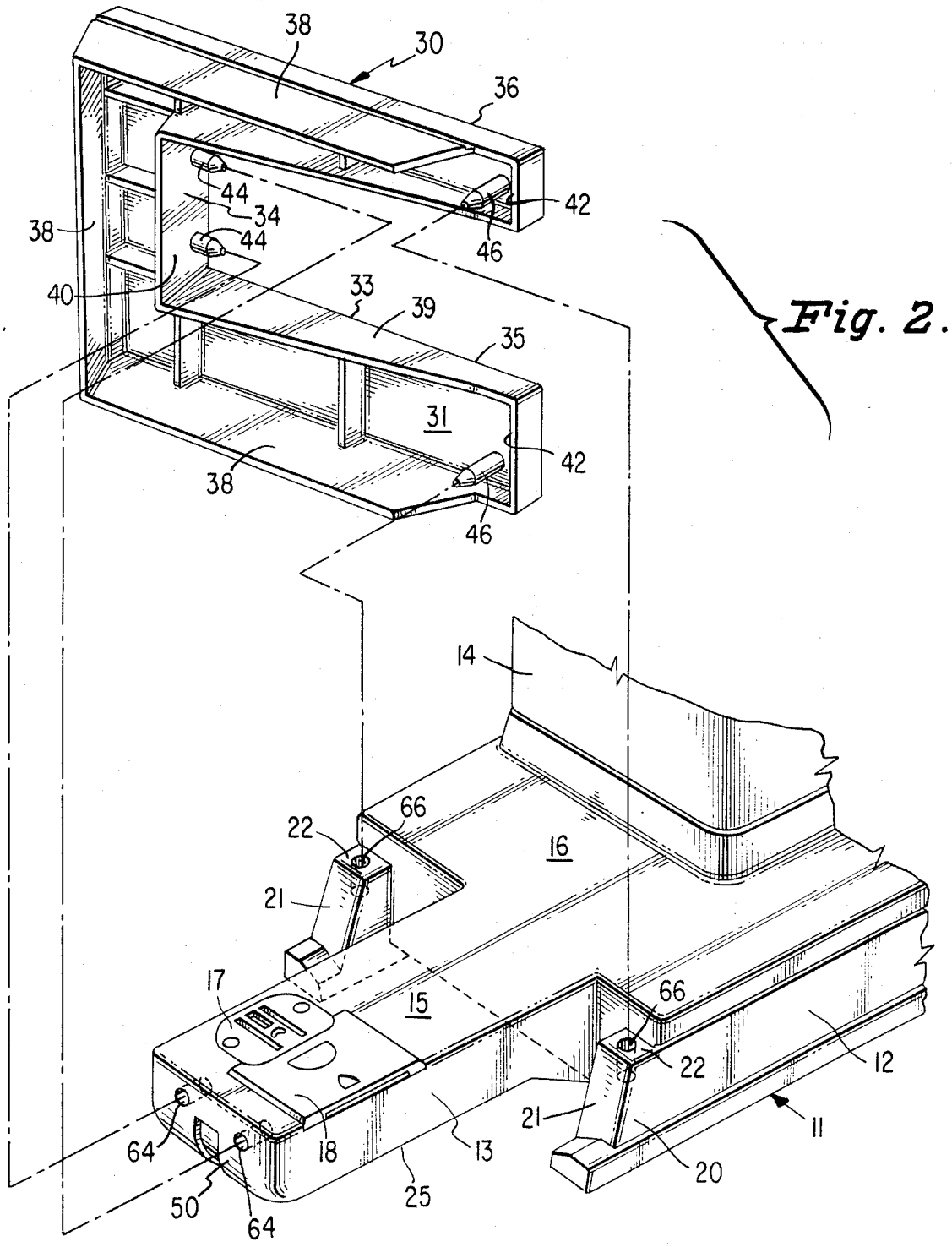
FIG. 2 is a perspective view similar to that of FIG. 1, but showing the bed extension detached from the sewing machine bed.

Depending from the outer sides of the base portion 34 and spaced arms 35–36 of the work supporting plate 31 is a skirt 38. Depending from the base portion 34 and spaced arms 35–36 of the bed extension work supporting plate 31 adjacent the central recess 33, thereof is a flange 39 which, as shown in FIG. 2, is preferably tapered from a relatively small dimension adjacent the free extremities of the arms 35–36 to a larger dimension substantially equal to that of the skirt 38 in that portion 40 of the flange 39 which extends across the base portion 34.

The cylinder bed free extremity 50 provides one bed extension locating surface on the sewing machine frame. The upper surfaces 22 of projections 20 provide other bed extension locating surfaces spaced from and related to the free extremity 50 by an angle A.

The flange portion 40 of the bed extension 30 provides a first segment of the bed extension which is shaped complemental to the free extremity 50 of the cylinder bed. The arms 35–36 of the U-shaped work supporting plate 31 are each provided at their free extremities with a down turned lip 42. The lips 42 are complimental to the upper surfaces 22 of the projections 20 and extend the same dimension beneath the bed extension work supporting surface 32 as the upper surfaces 22 of the projections are disposed beneath the work supporting surfaces 15 and 16 on the sewing machine bed. The bed extension 30 is formed such that when these bed extension segments 40 and 42 are positioned abutting their respective locating surfaces 50 and 22 in contiguous relation thereto, the planar work supporting surface 32 of the bed extension will extend coplanar with the cylinder bed work supporting surface 15. The flange portion 40, however, is formed with respect to the planar work supporting surface of the plate 31 of the bed extension at a smaller angle B than the angle A which the cylinder bed free extremity 50 makes with respect to the top surface 22 of the sewing machine frame projections 20. As a result, when attempt is made to shift the bed extension 30 into place against the cylinder bed 13, in order for the work supporting surface of the bed extension to remain coplanar with the cylinder bed work supporting surface 15, the flange portion 40 of the bed extension must be deformed with respect to the plate 31 and this deformation gives rise to internal stresses in the bed extension which provides for the secure locking thereof into the sewing machine and the resistance to dislodgement despite application thereto of usual forces incident to work manipulation during sewing or lifting of the sewing machine by gripping the free extremity of the bed extension thereon.

Extending into the central recess 33 of the bed extension work support substantially perpendicularly from the flange portion 40 are projections which may take the form of a pair of tapered pins 44—44 which are adapted to enter mating apertures 64—64 formed in the cylinder bed free extremity 50 when the bed extension is applied thereto.

Depending substantially perpendicularly from beneath the extremity of each arm 35–36 of the U-shaped work supporting plate 31 of the bed extension 30 is a projection which may take the form of a tapered pin 46, the pins 46—46 being positioned for accommodation each in one of a pair of mating apertures 66—66 formed one in each of the top surfaces 22 of the sewing machine base projections 20.

The top surfaces 22 of projections 20 are located beneath the level of the work supporting surfaces 15 and 16 by an amount substantially equal to the thickness of the lips 42—42 of the bed extension so that as the bed extension 30 is shifted into place on the sewing machine and the bed extension segments are forced into contiguity with the locating surfaces, the projections 20 maintain the work supporting surface of the bed extension coplanar with respect to the cylinder bed work supporting surface and cause the internal stress which is developed in the bed extension by deformation of the flange portion 40 to urge the bed extension segments firmly against the locating surfaces. Entry of the pins 44—44 into recesses 64—64 and pins 46—46 into recesses 66—66 will preserve the deformed state of the bed extension thus maintaining the advantageous locking force securing the bed extension in place.

Figure 3:
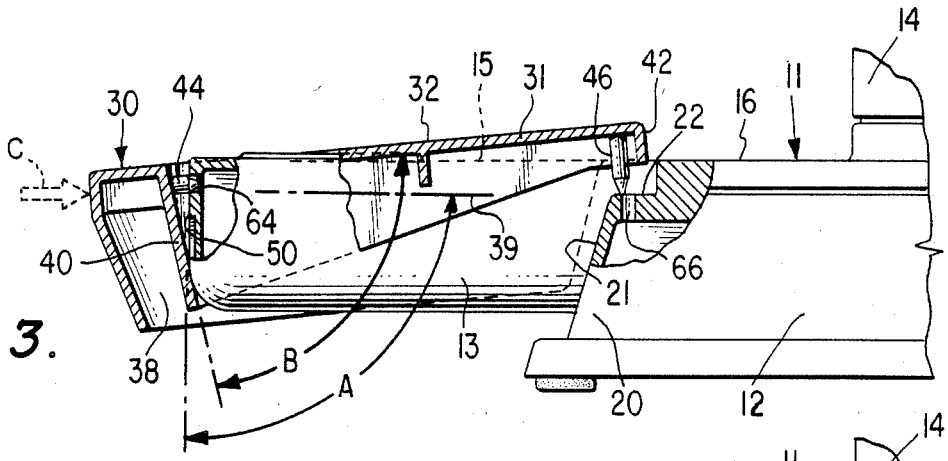
FIG. 3 is a cross sectional view taken substantially along line 3—3 of FIG. 1 showing the interrelation of the bed extension to the sewing machine bed as the bed extension is being applied but before any deformation of the bed extension occurs.
Figure 4:
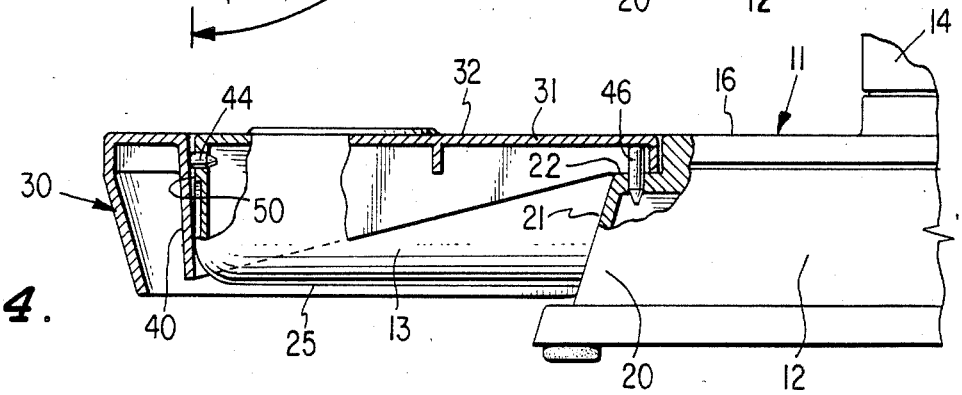
FIG. 4 is a cross sectional view similar to that of FIG. 3 but showing the bed extension completely in place on the sewing machine bed.

Since the above described locking force is not developed until the last movement of the bed extension into the sewing machine cylinder bed, the bed extension may be applied on the sewing machine with little or no resistance until the final movement, that is, from the position shown in FIG. 3 that that shown in FIG. 4. By the time the flange 40 of the bed extension begins to deform to generate the locking force, the pins 44—44 will have been cammed up to the level of the top surface 22 of the projections 20 by the inclined free extremities 21—21 thereof so that the bed extension can be applied simply by extending a force in the direction of the arrow C in FIG. 3 to the bed extension.

Seating of the pins 46—46 in the apertures 66—66 prevents retraction of the bed extension and thus maintains the flange deformation and the resulting internal stress in the bed extension to maintain the bed extension to maintain the bed extension in place.

The pins 44—44 seated in apertures 64—64 lock the free extremity of the bed extension to the cylinder bed free extremity so that the sewing machine may be lifted by lifting the free extremity of the bed extension; in fact, such action locks the bed extension more firmly in place.

Similarly, downward pressure applied to the bed extension adjacent the throat plate and slide plate of the sewing machine during manipulation of work fabric while sewing serves to increase the firmness of the bed extension fastening.

Because the dimensions of sewing machine beds may differ as may the dimensions which may be selected for web thicknesses, flange widths, etc., in the bed extension, no one specific difference can be set forth for the angular relation B between the bed extension flange and bed extension work supporting surface as compared with the angular relation A between the locating surfaces on the sewing machine frame. It has been found, however, that an angular difference sufficient to give rise to a locking force within the range of five to ten pounds between the U-shaped arms 35 and 36 of the bed extension work supporting plate 31 and the projections 20 of the sewing machine base will provide satisfactory interlock between these parts.

To remove the bed extension of this invention from the sewing machine, it is simply necessary to lift both U-shaped bed extension extremities by applying forces in the direction of arrows marked D in FIG. 1 until the pins 46—46 are free of the apertures 56—56. The internal forces within the bed extension caused by deformation of the flange 40 will then act to shift the bed extension outwardly and the bed extension will then be released from the sewing machine and may be withdrawn freely therefrom.

I claim:

1. A bed extension for a sewing machine having a frame including a supporting base, a cantilevered cylinder bed extending from said base and formed with a planar work supporting surface, and spaced angularly related bed extension locating surfaces;

said bed extension including a planar work supporting surface, and integral angularly related segments adapted when positioned abutting in contiguous relation with said locating surfaces on said sewing machine frame to position the working supporting surface of said bed extension coplanar with said cylinder bed work supporting surface;

the angular relation between said bed extension segments being formed less than the angular relation between said locating surfaces on said sewing machine frame so that deformation of said bed extension segments and development of internal stresses therebetween is required in order to position said segments in contiguous relation with said locating surfaces on said sewing machine frame;

said bed extension segments being biased against said locating surfaces of said sewing machine frame by said internal stresses;

each complemental set of sewing machine frame locating surface and bed extension segment being formed one with a substantially perpendicular aperture and the other with a substantially perpendicular projection arranged for engagement with said aperture to lock said bed extension on said sewing machine frame when said bed extension segments are positioned in contiguous relation with said sewing machine frame locating surfaces.

2. A bed extension for a sewing machine as set forth in claim 1 in which the planar work supporting surface of said bed extension comprises the upper surface of a work supporting plate having a recess complemental to the work supporting surface of the sewing machine cylinder bed, which recess forms the work supporting plate into a U-shape including a base from which spaced arms extend which spaced arms comprise ones of the said bed extension segments, and in which another of said bed extension segments comprises a flange depending substantially perpendicularly from said work supporting plate across the base of said U-shape thereof.

3. A bed extension for a sewing machine as set forth in claim 2 in which said locking apertures and projections are formed on said sewing machine frame and said bed extension flange and on said sewing machine frame and the free extremities of said work supporting plate arms.

4. A bed extension for a sewing machine as set forth in claim 3 in which said bed extension flange and the free extremities of said work supporting plate arms are formed with said projections adapted to lock with apertures formed in said sewing machine frame.

5. A bed extension for a sewing machine as set forth in claim 1 in which the angular relation between said bed extension segments is formed sufficently smaller than the angular relation between said locating surfaces on said sewing machine frame as to develop internal stresses between said bed extension segments to bias said segments against said locating surfaces with a force of between five and ten pounds when said segments are positioned in contiguous relation with said locating surfaces.

* * * * *